US008590111B2

(12) United States Patent
Hergeth

(10) Patent No.: US 8,590,111 B2
(45) Date of Patent: Nov. 26, 2013

(54) NON-WOVEN LAYING MACHINE AND A METHOD FOR LAYING A NON-WOVEN FABRIC

(76) Inventor: Hubert Hergeth, Zug (CH)

( * ) Notice: Subject to any disclaimer, the term of this patent is extended or adjusted under 35 U.S.C. 154(b) by 0 days.

(21) Appl. No.: 13/211,590

(22) Filed: Aug. 17, 2011

(65) Prior Publication Data

US 2012/0149272 A1 Jun. 14, 2012

(30) Foreign Application Priority Data

Aug. 18, 2010 (DE) ..... 10 2010 034 777

(51) Int. Cl.
*D01G 25/00* (2006.01)

(52) U.S. Cl.
USPC ..... 19/296; 19/302

(58) Field of Classification Search
USPC ..... 19/296, 302, 304
See application file for complete search history.

(56) References Cited

U.S. PATENT DOCUMENTS

| | | | | | |
|---|---|---|---|---|---|
| 2,996,102 | A | * | 8/1961 | Schuller | 65/450 |
| 3,066,358 | A | * | 12/1962 | Schiess | 28/103 |
| 3,220,811 | A | * | 11/1965 | Schuller | 65/479 |
| 3,235,913 | A | * | 2/1966 | Schuller | 19/305 |
| 3,645,814 | A | * | 2/1972 | Knoepfler et al. | 156/62.8 |
| 3,812,553 | A | * | 5/1974 | Marshall et al. | 19/302 |
| 3,844,751 | A | * | 10/1974 | Stewart | 65/377 |
| 4,065,832 | A | * | 1/1978 | Neuenschwander | 19/306 |
| 4,540,454 | A | * | 9/1985 | Pieniak et al. | 156/62.2 |
| 4,553,289 | A | * | 11/1985 | Strobl et al. | 19/161.1 |
| 5,007,137 | A | | 4/1991 | Graute | |
| 5,065,478 | A | * | 11/1991 | Furtak et al. | 19/296 |
| 5,182,835 | A | * | 2/1993 | de'Giudici | 19/296 |
| 5,527,171 | A | * | 6/1996 | Soerensen | 425/83.1 |
| 5,537,718 | A | * | 7/1996 | Nagatsuka et al. | 19/302 |
| 7,226,518 | B2 | * | 6/2007 | Loubinoux | 156/148 |
| 2002/0116793 | A1 | * | 8/2002 | Schmidt | 19/296 |
| 2005/0020164 | A1 | * | 1/2005 | Nakamura et al. | 442/181 |
| 2007/0226956 | A1 | * | 10/2007 | Causey et al. | 19/296 |

FOREIGN PATENT DOCUMENTS

| | | |
|---|---|---|
| WO | WO9630571 | 10/1996 |

* cited by examiner

*Primary Examiner* — Shaun R Hurley

(74) *Attorney, Agent, or Firm* — Lowe Graham Jones PLLC

(57) ABSTRACT

In order to produce air-laid non-woven fabrics with an adjustable strength ratio of the production direction and 90° to the production direction, two non-woven laying machines are set at an angle to the production direction.

22 Claims, 1 Drawing Sheet

- Prior Art -

NON-WOVEN LAYING MACHINE AND A METHOD FOR LAYING A NON-WOVEN FABRIC

PRIORITY CLAIM

This application claims priority to German application serial number 10 2010 034 777.9 filed on Aug. 18, 2010, which is hereby incorporated by reference in its entirety.

FIELD OF THE INVENTION

The present invention relates to machines and methods for laying a non-woven fabric, and, more particularly to producing two-layered non-woven fabric with fiber orientations in one layer being angled relative to the other layer.

BACKGROUND OF THE INVENTION

In the non-wovens industry machines have been used to produce non-woven fabrics from staple fibers for almost 100 years. The machines comprise a number of rollers which are provided with clothing and separate the fibers by carding and form a non-woven fabric on a doffer. Normal machines, also called "carding machines", produce a non-woven fabric that before further strengthening in downstream machines has a distortion resistance ratio in the direction of travel to transverse to the direction of travel of 10:1. By means of random rollers and stuffing rollers according to DIN 64118 the ratio can be improved to 4:1. By means of air-laid non-woven fabrics as in applications DE2535544 and DE 3901313 indicated as examples, this ratio can be improved to 3:1.

A further old method for producing non-woven fabrics is the use of a carding machine with cross layers and optionally a non-woven section. The preferably longitudinally orientated non-woven fabric (in the direction of travel) is fed to a cross layer by means of at least one conveyor belt. This cross layer deposits the non-woven fabric in a number of layers by means of conveyor belts on a depositing belt running at 90° to the draw-off direction. A subsequent non-woven section stretches this non-woven fabric so that approximately 1:1 strength is achieved.

SUMMARY OF THE INVENTION

This strength should be achieved with the present invention, but with considerably less complexity in machinery.

The complexity in machinery is considerably less. By getting rid of the iridescent movement of the cross layer, according to the invention the speed of the installation is approx. 10 times faster, and the non-woven fabric is more uniform because edges of the layers from which the non-woven fabric is formed are dispensed with.

Further objects of the invention are to improve the strength ratio to 1:1 and to make it adjustable. According to the invention this is achieved by the non-woven forming machine being positioned with its main axes at an angle different to the normal 90° to the direction of travel of the delivery belt.

By depositing the non-woven fabric in the orderly orientation, e.g. by means of a flow of air, the fibers can keep their orientation brought about by the opening, respectively, release rollers when depositing on the depositing belt because no continuous non-woven fabric is deposited. In order to achieve a better transverse rigidity ratio, at least two non-woven laying machines must work together. The strength of the non-woven fabric is achieved by two layers the main fiber alignment of which is displaced by approx. 90°. This leads to high strength in the longitudinal and transverse direction, similarly to by the alignment in a fabric. Conventional non-woven machines try to achieve a good longitudinal/transverse ratio by a random orientation of the fibers (sauerkraut effect). However, with these random orientation the fiber strength is not optimally utilized.

The fibers which are not aligned in the longitudinal or transverse direction only make a small contribution to these strengths.

By means of the adjustability of the angles of the non-woven machine to the conveyor belts, the strength ratios can be set almost infinitely without any major alterations.

On the same installation longitudinally orientated non-woven fabric or non-woven fabric with approximately up to the same longitudinal/transverse strength can be produced in rapid succession.

In order to achieve good depositing, the suction boxes beneath the conveyor belt or suction rollers are also pivoted when the non-woven machine is pivoted, or the opening slot of the suction box is also adjusted.

An opening that is too large for all of the adjustment positions would prevent precise depositing of the fibers due to uncontrolled air flows.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
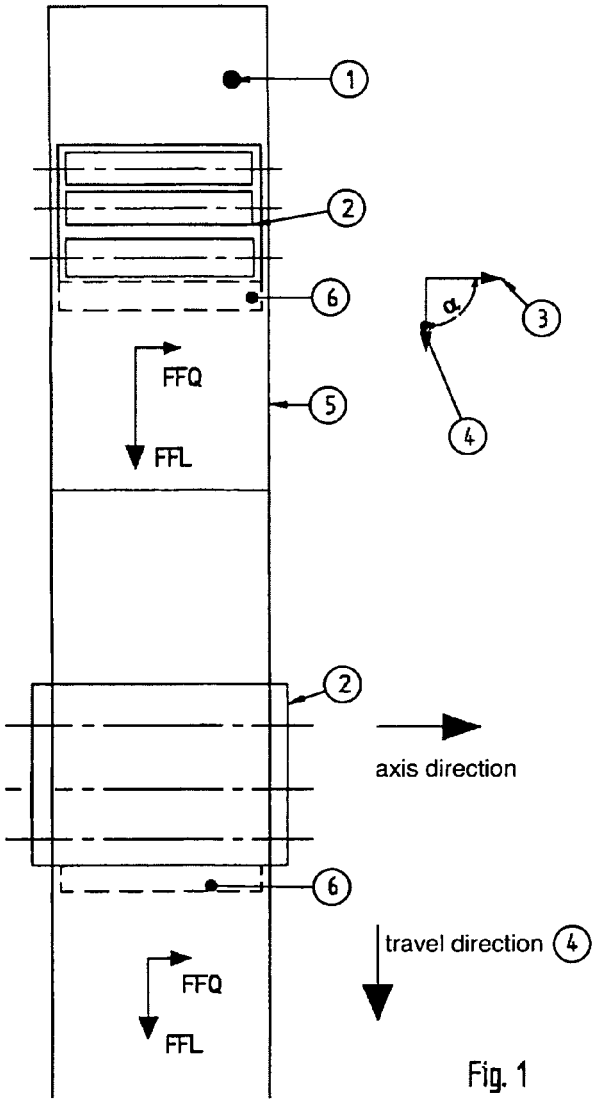
FIG. 1 shows the conveyance system with the fabric oriented at 90 degrees to the conveyance.

The invention is described by means of two figures. FIG. 1 shows the previous system. A non-woven forming machine 2) is positioned over a circulating delivery belt 1) with the roller with clothing sketched. The axis direction 3) of the rollers with clothing forms an angle of approximately 90° to the direction of travel of the delivery belt 1). The non-woven distortion resistance is approximately three times as great in the direction of travel FFL as transversely to the direction of travel FFQ. A number of machines one behind the other can also deliver to the same delivery system which can also comprise a number of belts or screen belts.

With a screen belt there are suction devices 6) for the fibers between the feed and return of the screen belt.

Figure 2:
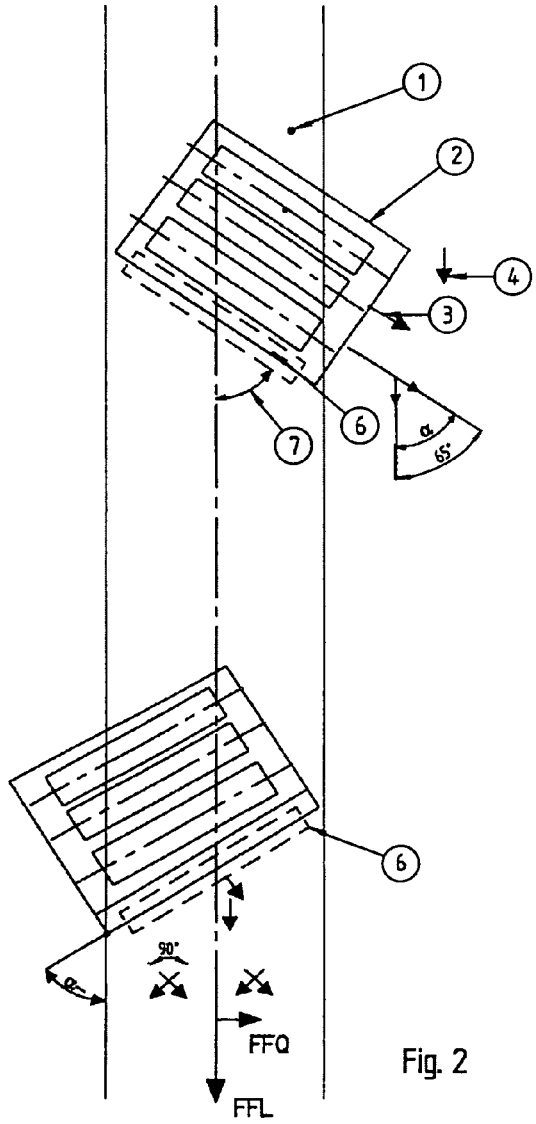
FIG. 2 illustrates an angled conveyance system of the present invention.

FIG. 2 shows this type of installation in an embodiment according to the invention.

The non-woven forming machines are disposed at a non-right angle $\alpha$ between the axis direction of their rollers with clothing and the direction of travel of the delivery system. After opening the fibers by a drum with steel clothing or pins the non-woven machine transfers the fibers to a flow of air which deposits the fibers on a screen belt or a screening drum and thus forms the non-woven fabric.

The delivery system 1), here preferably in the form of a screen belt runs in the direction of conveyance 4). Suction boxes 6) are located beneath the screen belt. The fibers are opened by a non-woven forming machine 2) and conveyed to the screen belt. The axes 3) of the opening rollers are at an angle $\alpha$) to the direction of conveyance of the delivery system. The suction opening of the suction box 6) is approximately parallel in its longitudinal axis to the axes of the opening rollers of the non-woven forming machine. The long conveyor belt of the conveying system 1) does not have to take over the fibers directly. The fibers can also be taken over by a short suction belt or a suction drum on which the non-woven fabric is formed, and from which the non-woven fabric is then passed onto the long conveyor belt which also takes over the non-woven fabric from a number of non-woven machines.

If a number of non-woven machines deliver to a conveying system, the machines must be arranged at opposing angles to the direction of travel of the conveying system in order to achieve the 1:1 strength ratio. With an air-laying non-woven machine the axes of the opening rollers (also called release rollers) would be at approx. +65° with the first machine and with the second machine at approx. −65° to the direction of travel of the discharge belt. In FIG. 2 these angles are identified by $+\alpha$ and $-\alpha$. Any separate optional shorter depositing belt for forming the non-woven fabric would be at approximately the same angles. The strength ratio can be adjusted if the non-woven laying machine and the suction box can be set at an angle to the delivery belt. This can be implemented by pivoting about a pivot point. In this simple way a non-woven fabric with adjustable strength ratios of up to 1:1 can be produced.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An installation for forming non-woven fabrics from fibers, the installation comprising:

a machine for forming a non-woven fabric, the machine having a suction box and at least one opening roller, the opening roller bringing about an orientation to the fibers;

a delivery system for delivering the formed non-woven fabric along a direction of delivery, wherein the suction box is underneath the delivery system with the delivery system between the suction box and the at least one opening roller, the suction box configured to apply suction to draw the fibers toward the delivery device, wherein the at least one opening roller has an axis of between ±8° and ±80° with the direction of delivery of the formed non-woven fabric, and wherein the machine is arranged to deposit the fibers on the delivery system with the fibers keeping the orientation brought about by the opening roller.

2. The installation according to claim 1, wherein the angle formed by the axis of the at least one opening roller of the machine with the delivery direction of the delivery system is adjustable.

3. The installation according to claim 2, wherein the angle is adjustable by adjusting the orientation of the machine including the at least one opening roller in relation to the delivery direction.

4. The machine according to claim 3, wherein the suction box of the machine includes a longitudinal suction opening running substantially parallel to the axis of the at least one opening roller.

5. The installation according to claim 4, wherein the longitudinal opening of the suction box is adjustable by adjusting the orientation of the machine including the suction box and the opening roller relative to the delivery direction.

6. The installation according to claim 4, including at least one air-laying machine for forming the non-woven fabric.

7. A method for forming non-woven fabrics from fibers, the installation comprising:

a first machine and a second machine for forming the non-woven fabric, the machines being arranged to deliver to a delivery system having a direction of delivery, wherein each machine having a suction box and at least one opening roller, the opening roller bringing about an orientation to the fibers;

wherein the suction box is underneath the delivery system and configured to draw the fibers toward the delivery device;

wherein the opening roller of the first machine is arranged at a positive angle of between +8° and +80° relative to the delivery direction, and the opening roller of the second machine is arranged at a negative angle of between −8° and −80° relative to the delivery direction, wherein the first and second machines are arranged to deposit the fibers on the delivery system with the fibers keeping the orientation brought about by the opening roller.

8. The method according to claim 7, wherein the angle of the first machine and the angle of the second machine have the same magnitude.

9. The method according to claim 7, wherein the angle of the first machine is +45° and the angle of the second machine is −45°.

10. The installation according to claim 4, wherein the machine is configured to deposit the fibers by means of an air stream.

11. A machine for forming non-woven fabrics from fibers along a direction of delivery along a conveyor, the machine including:

at least one opening roller for forming a non-woven fabric, the opening roller bringing about an orientation to the fibers, and a suction box beneath the conveyor and configured to draw the fibers toward the conveyor, wherein the at least one opening roller has an axis, the axis being arranged at an angle of between ±8° and ±80° in relation to the direction of delivery of the formed non-woven fabric, and the machine is arranged to deposit the fibers with the fibers keeping the orientation brought about by the opening roller.

12. The machine according to claim 11, wherein the suction box includes a longitudinal suction opening, the opening running substantially parallel to the axis of the at least one opening roller.

13. The machine according to claim 12, wherein the longitudinal opening is adjustable by adjusting the orientation of the machine including said suction box and said opening roller in relation to the delivery direction.

14. The machine according to claim 13, including at least one air-laying machine for forming the non-woven fabric.

15. The machine according to claim 13, wherein the machine is configured to deposit the fibers by means of an air stream.

16. A method for producing a non-woven fabric having at least two non-woven fabric layers, the layers being substantially formed from staple fibers and the method comprising:

forming a first non-woven fabric layer by depositing the fibers in an oriented manner on a delivery system having a delivery direction, thereby providing a main fiber orientation to the first fabric layer, the main fiber orientation of the first fabric layer having a first angle in relation to the delivery direction, and forming a second non-woven fabric layer by depositing the fibers in an oriented manner on the delivery system, thereby providing a main fiber orientation to the second fabric layer, the main fiber orientation of the second fabric layer having a second angle in relation to the delivery direction, wherein one of the first and second angle is negative in relation to the delivery direction and the other of the first and second angle is positive in relation to the delivery direction, the method further comprising:

providing a first machine including at least one roller having clothing and orienting the at least one roller of said first machine in a first direction, providing a second machine including at least one roller having clothing and orienting the at least one roller of said second machine in a second direction, forming the first non-woven fabric layer using the first machine, forming the second non-woven fabric layer using the second machine, wherein the first and second angles have a magnitude between about 25° and about 85°.

17. The method according to claim 16, wherein the magnitude of the angle is adjusted to be between about 8° and about 80°.

18. The method according to claim 17, wherein the first angle and the second angle are adjusted to have the same magnitude.

19. The method according to claim 16, wherein at least two layers of the non-woven fabric are not produced by means of a plaiter.

20. The method according to claim 16, wherein the main fiber direction of the first fabric and the main fiber direction of the second fabric form an angle, wherein the angle is at least 20°.

21. The method according to claim 16, wherein the first direction is adjusted according to the first angle and the second direction is adjusted according to the second angle.

22. The method according to claim 21, wherein the first and second angles have the same magnitude.

* * * * *